US005354018A

United States Patent [19]

Snead

[11] Patent Number: 5,354,018

[45] Date of Patent: Oct. 11, 1994

[54] RAILWAY FROG SYSTEM

[76] Inventor: Edwin deS. Snead, 701 E. University Ave., Georgetown, Tex. 78626

[21] Appl. No.: 719,991

[22] Filed: Jun. 24, 1991

[51] Int. Cl.[5] ..... E01B 7/08; E01B 7/16

[52] U.S. Cl. ..... 246/383; 246/429; 246/489

[58] Field of Search ..... 246/274, 376, 383, 384, 246/415 R, 417, 418, 410, 429, 489, 411

[56] References Cited

U.S. PATENT DOCUMENTS

| | | | |
|---|---|---|---|
| 154,439 | 8/1874 | Bacon | 246/469 |
| 348,516 | 8/1886 | Dunn | 246/383 |
| 712,802 | 11/1902 | Huson | 246/469 |
| 741,896 | 10/1903 | Eddy | 246/383 |
| 787,711 | 4/1905 | Williams | 246/384 |
| 820,406 | 5/1906 | Flugan | 246/385 |
| 891,411 | 6/1908 | Duffy | 246/329 |
| 899,967 | 9/1908 | Foster | 246/383 |
| 991,422 | 5/1911 | Buras et al. | 246/489 X |
| 1,131,025 | 3/1915 | Anderson | 246/429 |
| 1,219,794 | 3/1917 | Allen | 246/384 X |
| 1,222,577 | 4/1917 | Perkins | 246/383 |
| 1,470,495 | 10/1923 | Sosnoskey | 246/489 |
| 1,546,595 | 7/1925 | McClellan | 246/383 |
| 3,860,205 | 1/1975 | Dohse | 246/468 |
| 4,005,839 | 2/1977 | Frank | 246/415 R |
| 4,015,805 | 4/1977 | Friesenbichler et al. | 246/458 |
| 4,917,339 | 4/1990 | Durchschlag et al. | 246/382 |

*Primary Examiner*—Michael S. Huppert
*Assistant Examiner*—Scott L. Lowe
*Attorney, Agent, or Firm*—Arnold, White & Durkee

[57] ABSTRACT

An apparatus for switching a railroad car wheel from a first rail to a second rail including a base and a ramp member. The ramp member is hingedly connected to the base. The ramp member extends from the first rail to the second rail. The ramp member has a first angled portion at one end and a second angled portion at another end. The ramp member has a generally flat surface between the angled portions and has a thickness of greater than one and one-half inches. A frame extends upwardly from the base so as to support a hinge. The hinge extends in parallel relation to the base and to the ramp member. The ramp member is connected to the hinge by a plurality of struts. A lever-receiving receptacle is fastened to one of the struts so as to move in relation to the movement of the ramp member.

10 Claims, 2 Drawing Sheets

RAILWAY FROG SYSTEM

TECHNICAL FIELD

The present invention relates to railway frogs. More particularly, the present invention relates to manually operated frogs that assist in the turnout from main lines.

BACKGROUND ART

In 1990 U.S. railroads were hauling all commodities for an average freight rate of 2.7 cents per revenue ton mile compared to 8 cents per revenue ton mile for regulated gravel trucks. In order for railroads to take maximum advantage of their low costs, it is necessary for trains to be able to deliver directly to construction sites, rather than to unload into stock piles or into trucks for the final transportation to the user. This type of delivery is made possible in many cases because many highways were built adjacent to railroads. Also, many industrial plants were served by railroad tracks within the plants.

The present inventor is the owner of U.S. Pat. Nos. 4,925,356, issued May 15, 1990 for a "Self-Unloading Train for Bulk Commodities" and in U.S. Pat. No. 4,958,977, issued on Sep. 25, 1990 for a "System for the Transport of Bulk Commodities". The subjects of U.S. Pat. Nos. 4,925,356 and 4,958,977 have been commercially produced and sold by Conveying & Mining Equipment, Inc. of Houston, Tex. The product manufactured by this company under U.S. Pat. No. 4,925,356 is commonly known by the commercial trademark "DUMP TRAIN". The DUMP TRAIN is a unit train consisting of a plurality of hopper cars and a multi-purpose trailer car. The hopper cars have hoppers which have a bottom discharge opening and a controllable gate. An endless belt conveyor traverses the length of the train including a portion of the trailer car. The hopper discharge gates can be emptied sequentially onto the train conveyor so as to unload the entire train. This allows the DUMP TRAIN to deliver aggregate material to areas served by railroad tracks. Prior to the development of the DUMP TRAIN, it was necessary for such hopper cars to deliver their loads to unloading facilities. From the unloading facilities, it was necessary for trucks, or other modes of transportation, to haul the aggregate to the desired work site. The development of the DUMP TRAIN allowed the railroads to serve areas that were previously inaccessible by rail or by truck.

U.S. Pat. No. 4,958,977 describes a product that is known in the trade by the trademark "SLOT MACHINE". The SLOT MACHINE is a material transport system having a material container which extends along a flat floor throughout the length of the train. A pair of side walls extend upwardly on each side of the flat floor. An unloader, in the form of a tractor/bucket, is placed into this flat roadway within the train so as to carry out the mechanical loading and/or unloading of the train. The SLOT MACHINE was developed to further utilize the economics of rail transportation for the delivery of material to desired locations.

The ability of the SLOT MACHINE and the DUMP TRAIN to serve work sites is somewhat limited by the location of the railroad tracks. Ultimately, it would be desirable to be able to install rail lines that extend from the main line to the work site. It is also important to be able to connect the main line to existing, generally unused, track that extends into areas of need.

A limitation on the ability to move the SLOT MACHINE, the DUMP TRAIN, and other forms of rail transportation, to remote work sites is the cost, trouble, and difficulty of installing switching systems off the main line. Typically, switching systems are extremely expensive, require railroad approval, and must be maintained constantly. Typical railroad switching systems are unsuitable for the occasional use that would be required of them for the delivery of aggregate materials along branch lines to work sites. Each switching system must be adapted to the particular needs along the given area of rail track. There is no current switching system that is economically and practically possible when the branch line is only used occasionally.

In some cases, it is practical for unit trains like the DUMP TRAIN or the SLOT MACHINE to make deliveries from railroad main lines. However, this is potentially disruptive of the business of the railroads. The utilization of the DUMP TRAIN or the SLOT MACHINE on the main lines of the railroad should be avoided if at all possible. In most cases, it is desirable to have a switch or "turnout" to allow trains to get off the main lines and onto temporary tracks, or branch lines, for delivery purposes.

Switches are a major source of concern for trunkline railroads. They require far more maintenance than ordinary track. Unless such switches are under close control by railroad personnel, they can easily be the cause of derailments and train wrecks. In particular, centralized traffic control is sensitive to switches. The position of every switch on the main line must be constantly monitored by the dispatcher and his computer. In many cases, the switch can be operated by a dispatcher a thousand miles away. However, it is not sufficient to give the order to turn a switch. It is also essential to have the feedback to know that the switch is safely aligned in the desired position. The long communication lines for control and feedback can be a large part of the capital costs of a railroad switch.

For these reasons, railroads are reluctant to install new switches in their territory. They must be assured of a large volume of traffic to economically justify the direct costs, added risks, and supervision.

Nearly all switches that are installed on the main line of the railroad are designed for fairly high speed trains, some as high as ninety miles per hour. In contrast, the delivery of construction materials, such as by the DUMP TRAIN or by the SLOT MACHINE, is done at very low speeds. A switch capable of handling a train at five miles per hour, or less, is adequate for the purpose of the delivery of construction materials.

Various United States patents have been issued in the past which attempt to address the problems of railroad switches and which describe various frog systems. U.S. Pat. No. 154,439, issued on Aug. 25, 1874, to B. Bacon was an early development in the technology of railroad switches. This early development in switches formed a railway switch by raising the switch-wheels the width of the wheel flanges higher than the main rails, so as to dispense with frogs and nearly all of the guide rails of ordinary switches.

U.S. Pat. No. 712,802, issued on Nov. 4, 1902, describes a railroad frog which utilizes an elevating lateral rail (or shoe) provided with a longitudinal groove inclined downwardly and convergently joined to a main-track rail. A rail is arranged on the opposite side of the main-track rail and is adapted to receive the tread of the car wheel which is elevated by the lateral track. This enables the wheel to clear the main track rail.

U.S. Pat. No. 787,711, issued on Apr. 18, 1905, shows an emergency switch and frog. In this system, the main line has a hinged point of which one part of the point passes upon and over the main rail and another part of the point enters the groove of the main rail combined with a clamp and a wedge for securing the main rail.

U.S. Pat. No. 820,406, issued on May 15, 1906, shows a railroad frog system which consists of a rail-section swinging from one end between the terminals of two adjacent track-rails to fill the intervening gap and to produce a continuous line of rails. The rail section has a laterally extending base of greater width than the height of the rail.

U.S. Pat. No. 891,411, issued on Jun. 23, 1908, describes a switch operating apparatus, in the form of a frog, which is remotely operated by the moving car.

It is an object of the present invention to provide a frog switching system that is simple to manufacture, easy to install, and relatively inexpensive.

It is another object of the present invention to provide a railroad frog system that enhances the ability of the main railroad line to serve branch lines.

It is a further object of the present invention to provide a railroad frog system that can be manually installed and operated.

It is still a further object of the present invention to provide a railway frog system that does not interfere with the operation of rail traffic from the main line.

These and other objects and advantages of the present invention will become apparent from a reading of the attached specification and appended claims.

SUMMARY OF THE INVENTION

The present invention is an apparatus for switching a railroad car wheel from a first track to a second track which comprises a base and a ramp member hingedly connected to the base. The ramp member extends from the first track to the second track. The ramp member has a first angled portion at one end and a second angled portion at another end. A generally flat surface extends between these first and second angled portions. The flat surface has a thickness of greater than one and one-half inches.

The base is a flat longitudinal member which includes means for affixing to an exterior surface, such as railroad ties. In normal use, the base is positioned adjacent to and aligned with the railroad tracks. A frame extends upwardly from this base. The frame rigidly supports a hinge in parallel relationship to the base and to the ramp member. The ramp member is connected to the hinge by a plurality of struts. One of the struts includes a lever-receiving receptacle. The lever-receiving receptacle is rotatable with respect to the frame. The movement of the lever-receiving receptacle causes a corresponding movement of the ramp member. Specifically, the lever-receiving receptacle is a V-shaped receptacle one of a plurality of struts having a narrow end adjacent to the hinge. The open end of the V-shaped receptacle is adjacent to the ramp member.

The ramp member is movable between a first position and a second position. The first position is juxtaposed to the top surface of the first and second tracks. The second position is distal the first and second tracks. The ramp member rotates about the hinge when moving from the first position to the second position.

The present invention is also a frog system for switching between a first railroad track and a second railroad track. This frog system includes first and second rails supported in parallel relationship on a plurality of railroad ties. A third rail is positioned in close proximity to the first rail. The third rail is also supported by railroad ties and extends in a different direction than the first and second rails. A fourth rail has an end in close proximity to the second rail and extends in parallel relationship to the third rail. The fourth rail has another end which is in close proximity to the first rail. A fifth rail has an end in close proximity to the first rail and is aligned with the fourth rail. The fifth rail is in parallel relationship to the third rail. In essence, the fourth and fifth rails are the same rail but are split so as to accommodate the passing of the first rail therethrough. A first ramp member is positioned adjacent to the first rail and to the third rail. The first ramp member is movable so as to extend from the first rail to the third rail. A second ramp member is positioned adjacent to the second rail and to the fourth rail. The second ramp member is positioned so as to extend from the second rail to the fourth rail. Finally, a third ramp member is positioned adjacent to the fourth rail and to the fifth rail. The third ramp member is positioned on the fourth and fifth rail so as to extend over the top of the first rail. Each of the ramp members has a configuration described herein previously. In normal use, the ramp members are mounted to the exterior of the railroad track and positioned onto the railroad ties.

The first ramp member has an edge which is in alignment with an inner edge of the first and third rails. The second ramp member has an edge in alignment with an inner edge of the second rail and the fourth rail. The third ramp has an edge which is in alignment with the inner edge of the fourth and fifth rails. Each of the first, second, and third ramp members are movable between a first position and a second position. The first position is juxtaposed to a top surface of the corresponding rails. The second position is rotated so as to be distal the rails.

In order to effect the proper switching from the main line to the branch line, it is necessary for each of the three ramp members to be rotated into its position overlying railroad tracks. The flange of the railroad car wheel will follow a path along the inner edge of each of the ramp members. The ramp members will elevate the railroad car wheel above the main line tracks so that the railroad car wheel passes to the corresponding rail on the branch line.

DETAILED DESCRIPTION OF THE INVENTION

Figure 1:
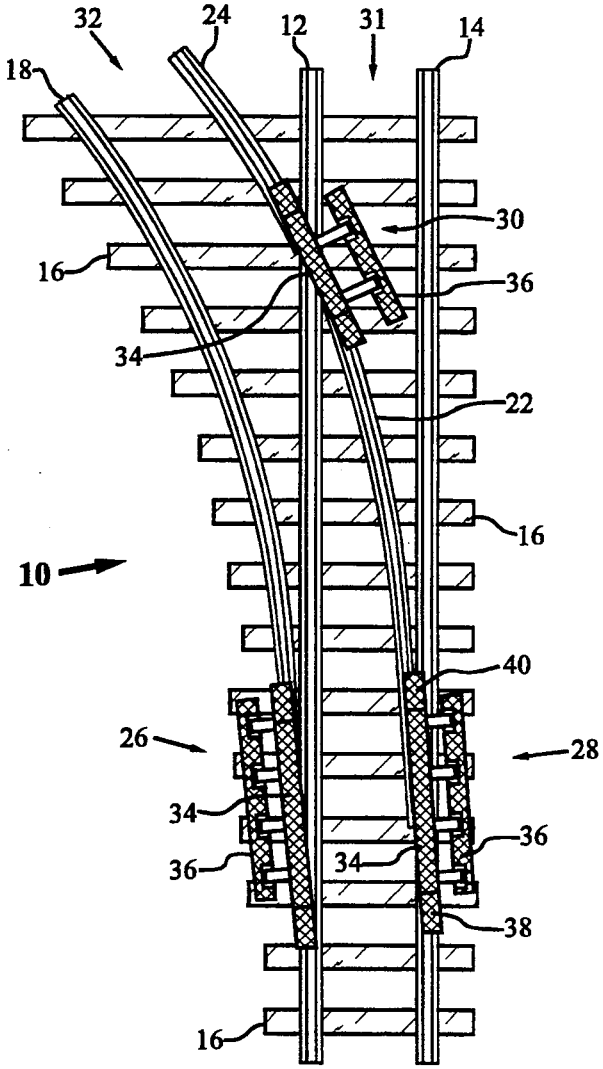
FIG. 1 is a top view of the frog system of the present invention showing each of the ramp members in proper position over the railroad tracks.

Referring to FIG. 1, there is shown at 10 the frog system for switching between a first railroad track and a second railroad track. Frog system 10 has a first rail 12 and a second rail 14 supported in parallel relationship on a plurality of railroad ties 16. A third rail 18 has an end which contacts or is in very close proximity to the first rail 12. The third rail is supported by the second plurality of railroad ties 16. The third rail 18 extends to the side in a different direction than the first rail 12 and the second rail 14. A fourth rail 22 has one end in close proximity to the second rail 14 and another end in close proximity to the first rail 12. The fourth rail 22 extends in parallel relationship to the third rail 18. A fifth rail 24 has an end which contacts or is in close proximity to the first rail 12. The fifth rail 24 is aligned with the fourth rail 22 and extends in parallel relationship to the third rail 18. The fourth rail 22 and the fifth rail 24 are supported by the plurality of railroad ties 16.

The frog system 10 of the present invention employs three ramp members 26, 28 and 30 so as to effect the switching between the first track 31 and the second track 32. The first track 31 is made up of the first rail 12 and the second rail 14. The second track 32 is made up of the third track 18 and the fifth track 24.

As can be seen, the first ramp member 26 is positioned adjacent to the first rail 12 and the third rail 18. The first ramp member 26 extends between the first rail 12 and the third rail 18. The second ramp member 28 is positioned adjacent to the second rail 14 and the fourth rail 22. The second ramp member 28 extends from the second rail 14 to the fourth rail 22. The third ramp member 30 is positioned adjacent to the fourth rail 22 and the fifth rail 24. The third ramp member 30 extends from this fourth rail 22 to this fifth rail 24 and passes over the top of the first rail 12. When each of the ramp members 26, 28 and 30 are in the position illustrated in FIG. 1, a railroad car travelling down the first track 31 will be switched onto the second track 32. If the ramp members 26, 28 and 30 are removed, then the railroad car travelling down the first track 31 will remain on the first track and continue along the path represented by rails 12 and 14.

Each of the ramp members 26, 28 and 30 has a somewhat similar configuration. As will be described in further detail in connection with FIGS. 3-5, each of the ramp members comprises a flat member 34 and a base member 36. The flat member 34 rests in juxtaposition to the top surface of the rails. The flat member 34 has a thickness of greater than one and one-half inches so as to accommodate the size of the flange of common railroad wheels. The one and one-half inch thickness need only occur in the particular area in which the railroad car wheel passes over an underlying track. Each of the flat members 34 has a first angled end 38 and a second angled end 40. These angled ends narrow away from the flat member 34 toward the corresponding track. As such, the angled ends serve to lift the railroad car wheel from the corresponding rail and to lower such railroad wheel onto another rail. By lifting the railroad car wheel, the ramp members cause the flange of the railroad car wheel to clear the underlying track.

The base member 36 is affixed to a portion of the plurality of railroad ties 16. The flat member 34, as will be described hereinafter, is hingedly connected to the base member 36. The flat member 34 will rotate about a hinge so as to be placed in proper position onto the top of the corresponding rail or to be removed from such a rail.

Figure 2:
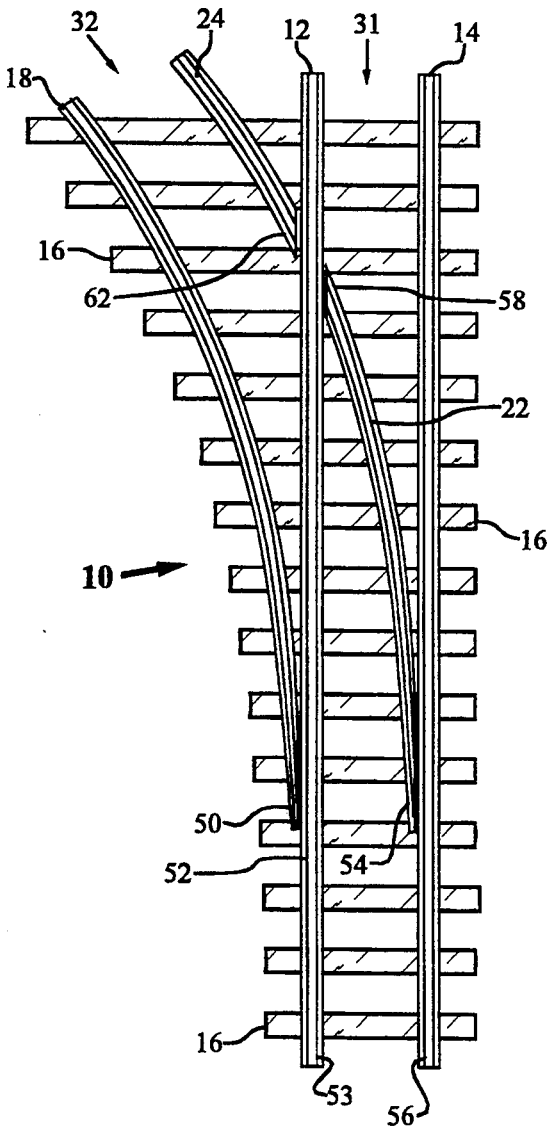
FIG. 2 is a top view showing the configuration of the railroad tracks with the ramp members removed.

FIG. 2 illustrates the tracks 31 and 32 of FIG. 1 without illustrating the ramp members 26, 28 or 30. In keeping with the present invention, the ramp members 26, 28 and 30 can be permanently affixed or can be removably affixed to the corresponding ties. If it is only necessary to use the track 32 on rare occasions, then the ramp members may be removed from the ties so that no interference is possible with the normal operation of the main track 31. However, if the branch line 32 is to be used rather frequently, then it may be desirable to permanently affix the base 36 of each of the ramp members to the corresponding railroad ties. In this manner, the ramp member can be rotated so as to be in position whenever necessary. As can be seen, the main track 31 is made up of the first rail 12 and the second rail 14. First rail 12 and second rail 14 are supported on a plurality of railroad ties 16. In normal use, a railroad car will travel along the main track 31 in the straight fashion illustrated in FIG. 2.

The branch line 32 is made up of the third rail 18 and the fifth rail 24. These rails are supported on the plurality of railroad ties 16. It can be seen that the ties have increasing lengths as they accommodate the curved track of the branch line 32. As the branch line 32 splits further from maine line 31, ties 16 of conventional size are used to support the track 32. Fourth rail 22 is placed into the area of the main track 31 so as to extend from the second rail 14 to the first rail 12. The fourth rail 22 and fifth rail 24 are part of the branch line 32. The fourth rail 22 is in proper alignment with the fifth rail 24. A split is made between the rails 22 and 24 so as to accommodate the passage of the first rail of the main track 30 therethrough. Sufficient clearance should be provided between the ends of the the fourth rail 22 and the fifth rail 24 so as to allow the railroad car wheel passing on the main track 30 to be free from any interference.

It can be specifically seen in FIG. 2 that the third rail 18 travels a curved path until the end 50 resides in close proximity to the outer surface 52 of the first rail 12. However, this is not critical to the structure of the present invention. End 50 of third rail 18 may actually be in contact with the outer surface 52 of first rail 12. Since the flange of a railroad car wheel travels along the inner surface 53 of rail 12, there can be no problem caused by contact between end 50 and rail 12. The fourth rail 22 has end 54 residing in close proximity to the inner surface 56 of the second rail 14. The fourth rail 22 travels for a short distance and terminates at end 58 in close proximity to the inner surface 53 of the first rail 12. The spacing between the ends 54 and 58 of rail 22 and the respective rails 14 and 12 should be sufficient to allow the flange of a railroad car wheel to pass therethrough. The fifth rail 24 has end 62 placed in close proximity to the outer surface 52 of first rail 12. Once again, however, the fifth rail 24 may be in contact with the outer surface 52 of first rail 12.

The ramp members 26, 28, and 30 are employed so as to allow the railroad car wheel to appropriately transfer from the rails of the main track 31 onto the rails 18 and 24 of the branch line 32. The branch line 32 can be an established railroad track extending from the main track 31 or it can be a temporary set of panel tracks which are placed in position for the purposes of short term haulage to a desired location. As stated previously, the ramp members can be permanently installed for continual usage or can be removably installed for occasional operations. The system of the present invention allows for rare and occasional switching activities to occur from the main track 31 without the need for the expensive conventional switching equipment currently employed. The ramp members and the auxiliary track do not interfere with conventional operations on the main track.

With respect to the illustrations of FIGS. 1 and 2, it should be noted that several items are illustrated for the purpose of clarity. Under usual conditions, the branch line 32 cannot have a curvature as shown. The branch line 32 will normally extend from main line 31 with a curvature of less than ten degrees (10°). Additionally, with respect to FIG. 1, the third ramp member 30 will have a size which conveniently fits between the rails 12 and 14. Third ramp member 30 is shown in exaggerated proportion for illustrative purposes. When not in use, the third ramp member 30 will reside within the confines of rails 12 and 14. Additionally, the arrangement of ties 16 may have a variety of configurations. For example, ties 16 may be of conventional size, but arranged in an alternating fashion. Also, the ties that support branch line 32 may be spaced to coincide with alternating ties of main line 31. The construction illustrated in FIGS. 1 and 2 is intended to show the scheme of the present invention. The specific structure, as illustrated, is not intended to limit the scope of the present invention.

Figure 3:
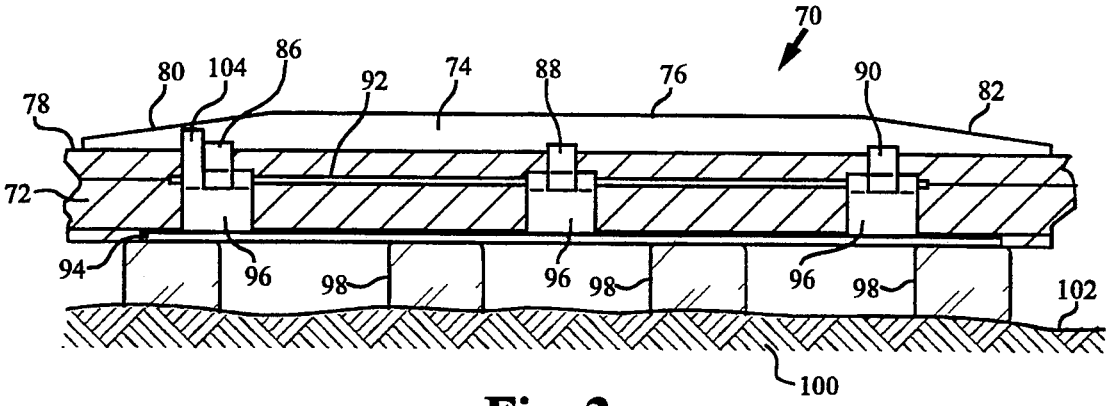
FIG. 3 is a side view showing the configuration of a single ramp member as positioned onto the railroad track.

FIG. 3 shows the ramp member 70 in its proper position on rail 72. It can be seen that the ramp member 70 has a longitudinal flat member 74. Flat member 74 has an upper surface 76 which is in parallel relationship to the top surface 78 of rail 72. At the ends of the flat member 76 are angled ends 80 and 82. Ends 80 and 82 angle from the flat member 74 toward the top surface 78 of the rails. A feather edge 84 occurs at each of the angled ends 80 and 82 so as to allow the railroad car wheel to easily move upwardly onto the flat member 74. The railroad car wheel will pass from one rail to another rail by travelling over the top surface 76 of the flat member 74.

The flat member 74 is connected by a plurality of struts 86, 88, and 90 to a hinge 92. The hinge 92 is a rod that extends in parallel relationship to the base member 94 and to the flat member 74. A frame 96 extends upwardly from the base member 94 and receives the hinge 92. The frame 96 supports the hinge. The hinge engages the struts 86, 88, and 90. In this configuration, the flat member is free to rotate about the hinge 92. The base member 94 is a flat longitudinal member having suitable means for affixing to an exterior surface, such as ties 98. The base member 94 may be affixed to ties 98 by spiking. As illustrated in FIG. 3, the ties 98 are supported on the earth 100 or embedded into earth 100. If the ties 98 are part of a panel track system, then the ties 98 will be supported on the surface 102 of earth 100. If the rail 72 is a conventional rail, then the ties 98 will be partially embedded into the earth 100.

A lever-receiving receptacle 104 is attached to the strut 86. As will be described hereinafter, the lever-receiving receptacle 104 is rotatable with respect to the frame 96 and the base 94. A movement of the lever-receiving receptacle 104 causes a corresponding movement of the ramp member 70.

Figure 4:
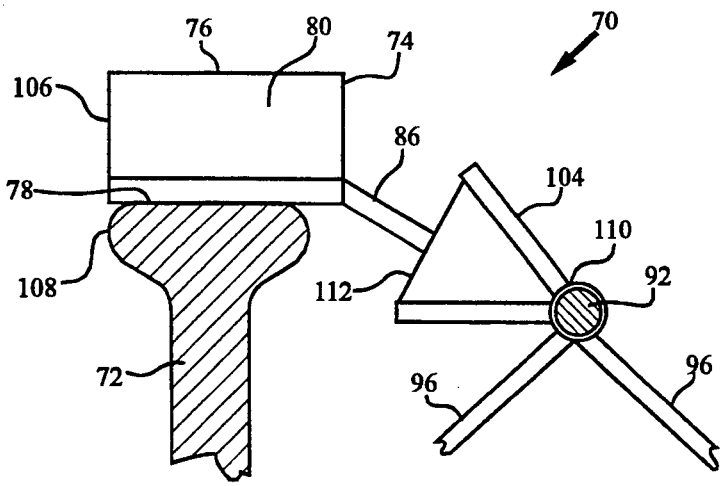
FIG. 4 is an end view of the ramp member as positioned on the rail.

FIG. 4 shows an end view of the ramp member 70 as in a first position on the rail 72. It can be seen that the ramp member 70 includes the flat member 74 which has a top surface 76 at least one and one-half inches above the top surface 78 of rail 72. It can further be seen that the flat member 74 has an inner surface 106 which is a aligned with the inner edge 108 of rail 72. Since the flange of the railroad car wheel travels in abutment with the inner edge 108 of the rail 72, it is necessary for the ramp member 70 to have an inner surface 106 which is aligned with the inner surface 108 of rail 72. In this manner, when the ramp 80 lifts the railroad car wheel, the flange of the railroad car wheel will continue in its traditional path along the inner surface 106 of the ramp member 70.

FIG. 4 also shows that the flat member 74 extends from the hinge 92 by a strut 86. The lever-receiving receptacle 104 is a V-shaped receptacle fastened to the strut 86 having the narrow end 110 fastened to the hinge 92. The V-shaped receptacle 104 opens at 112 generally adjacent to the flat member 74. The hinge 92 is supported by frame 96. As can be seen, the frame 96 is an angle iron that extends downwardly toward the base 94.

It is important to the present invention that the lever-receiving receptacle is operationally connected to the ramp member 70. Since the flat member 74 of ramp member 70 is a solid piece of steel, the flat member 74 is extremely heavy. In order to effectively remove the flat member 74 from its position on the top of rail 72, it is necessary to rotate the flat member 72 about the hinge 92. After experimentation, it was found that mere human effort, without leverage, is unable to accomplish this task. Therefore, it was necessary to install a lever-receiving receptacle 104 so that a long lever can be inserted therein to assist in the rotation of the flat member 74. The receptacle 104 can take on a wide variety of configurations. Most importantly, to accomplish the desired effect, it is necessary to have an opening which allows for the insertion of a lever and allows for sufficient leverage to be applied to the ramp member 70 for the purposes of rotating the flat member 74 about the axis of hinge 92.

Figure 5:
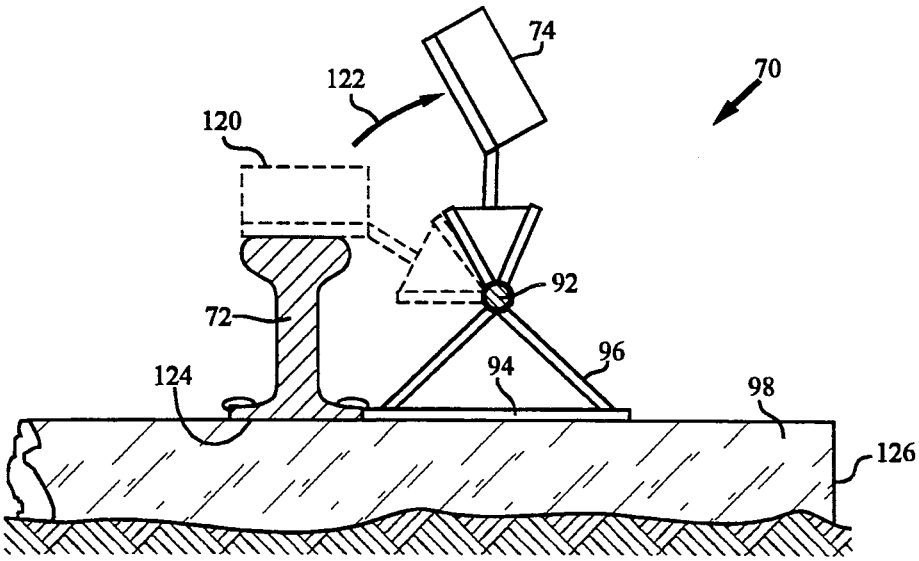
FIG. 5 is an end view, similar to that shown in FIG. 4, illustrating the rotation of the ramp member about the hinge.

FIG. 5 shows the movement of the flat member 74 about the axis of hinge 92. It can be seen that the ramp member 70 is free to move from the position illustrated at 120 (in dotted line fashion) in the direction of arrow 122. It can further be seen that the hinge 92 is supported by frame 96 as extending upwardly from the base 94 on railroad tie 98. The base 94 is aligned with, and in generally parallel relationship with, the base 124 of the rail 92. Continued rotation about the hinge 92 will cause the flat member 74 to reside distal the rail 72 adjacent the end 126 of tie 98.

The ramp member of the present invention is relatively easy to install. A simple staking of the base to the railroad ties allows for the proper positioning of the ramp member adjacent to the rails. The rotation of the flat member about the hinge brings the flat member into its location in proximity to the top of the rail. This allows for any wheel of a railroad car to be lifted from the track and transported toward the desired track. In relation to FIG. 1, the railroad car wheels will move from the main line track 31 onto the auxiliary track 32.

The present invention further enhances the ability of railroads to accommodate the needs of users off the main line. The ability to install panel track extending from the main line can allow devices such as the DUMP TRAIN or the SLOT MACHINE to serve remote work sites. Since construction materials are normally delivered in low speed operation, there is no need for the frog system, described herein, to satisfy high speed requirements. It has been found that the frog system, as described herein, can accommodate railroad cars travelling at five miles per hour.

Unlike prior art switching systems, the ramps of the present invention are relatively inexpensive to manufacture. They are simple to install and easy to maintain. Unlike conventional switching systems, there is no need to pay close attention to the operability of the system. The ramps can be positioned, as illustrated, whenever there is a need for a load of material to be delivered from a main line to the auxiliary line.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

I claim:

1. An apparatus for switching a railroad car wheel from a first rail to a second rail comprising:

a base;

a ramp member hingedly connected to said base member, said ramp member having a length suitable for extending from the first rail to the second rail, said ramp member having a first angled portion at one end, said ramp member having a second angled portion at another end, said ramp member having a generally flat surface between said first and second angled portions, said flat surface having a thickness of greater than one and one-half inches; and a frame extending upwardly from said base, said frame rigidly supporting a hinge, said hinge extending in parallel relation to said base, said ramp member arranged in parallel relation to said hinge, said ramp member connected to said hinge by a plurality of struts, said hinge having a lever-receiving receptacle attached thereto, said lever-receiving receptacle rotatable with respect to said frame, a movement of said lever-receiving receptacle causing a corresponding movement of said ramp member, said lever-receiving receptacle opening toward said ramp member, said lever-receiving receptacle comprising a V-shaped receptacle having a narrow end fastened adjacent to said hinge, said V-shaped receptacle opening adjacent said ramp member.

2. The apparatus of claim 1, said base being a flat longitudinal member, said base having means for affixing to an exterior surface.

3. The apparatus of claim 1, said ramp member movable between a first position and a second position, said first position being juxtaposed to a top surface of the first and second rails, the second position being distal said first and second rails.

4. A frog system for switching between a first railroad track and a second railroad track comprising:

a first rail and a second rail positioned in parallel relationship;

a third rail having an end in close proximity to said first rail, said third rail extending in a different direction than said first and second rails;

a fourth rail having an end in close proximity to said second rail, said fourth rail extending in parallel relation to said third rail, said fourth rail having another end in close proximity to said first rail;

a fifth rail having an end in close proximity to said first rail, said fifth rail aligned with said fourth rail and in parallel relation to said third rail;

a first ramp member positioned adjacent said first rail and said third rail, said first ramp member positionable so as to extend from said first rail to said third rail;

a second ramp member positioned adjacent said second rail and said fourth rail, said second ramp member positionable so as to extend from said second rail to said fourth rail; and a third ramp member positioned adjacent said fourth rail and said fifth rail, said third ramp member positionable so as to extend from said fourth rail to said fifth rail, said first, second and third ramp members each comprising:

a flat member having a thickness of greater than one and one-half inches, said flat member having angled ends that narrow away from said flat member; and a base member affixed to a plurality of railroad ties, said flat member hingedly connected to said base member, said base member comprising:

a frame affixed to the plurality of railroad ties, said frame supporting a hinge, said hinge extending in parallel relation to said flat member, said flat member connected by a plurality of struts to said hinge, said hinge having a lever-receiving receptacle attached thereto, said lever receiving receptacle rotatable about an axis of said hinge such that a movement of said lever-receiving receptacle causes a corresponding movement of said flat member, said lever-receiving receptacle comprising a V-shaped receptacle having a narrow end fastened adjacent to said hinge, said V-shaped receptacle opening adjacent said ramp members.

5. The frog system of claim 4, each of said first, second, third, fourth, and fifth rails supported by a plurality of railroad ties.

6. The frog system of claim 4, said first ramp member having an edge in alignment with an inner edge of said first and third rails, said second ramp member having an edge in alignment with an inner edge of said second rail and said fourth rail, said third ramp member having an edge in alignment with an inner edge of said fourth and fifth rails, said third ramp member overlying said first rail.

7. The frog system of claim 4, each of said first second, and third ramp members movable between a first position and a second position, said first position having said flat member juxtaposed to a top surface of at least one of said rails, said second position having said flat member distal at least one of said rails.

8. The frog system of claim 4, said first and second ramp members each having its base member affixed to said railroad ties adjacent an outer surface of said first and second rails, respectively.

9. An apparatus for connecting sections of railroad track comprising:

a first rail;

a second rail having an end in close proximity to said first rail, said second rail extending in a different direction than said first rail, said first and second rails supported by a plurality of railroad ties;

a base member fastened adjacent to said first and second rails on a portion of said plurality of railroad ties; and a ramp member hingedly connected to said base member, said ramp member juxtaposed to a top surface of said first and second rails, said ramp member having an inner edge aligned with an inner edge of said first and second rails, said ramp member movable away from said first and second rails, said ramp member having a thickness of greater than one and one-half inches along a portion of a length of said ramp member, said base member having a frame extending upwardly therefrom, said frame supporting a hinge thereon, said hinge aligned in parallel to said ramp member, said ramp member connected to said hinge by a plurality of struts, said hinge having a lever-receiving receptacle affixed thereto, said lever-receiving receptacle movable in relation to a movement of said ramp member, said lever-receiving receptacle being in the form of a V-shaped receptacle fastened adjacent said hinge, said V-shaped receptacle extending outwardly of said hinge so as to open adjacent said ramp member.

10. The apparatus of claim 9, said ramp member having a first angled end narrowing to the top surface of said first rail, said ramp member having a second angled end narrowing to the top surface of said second rail, said ramp member having a flat section between said first and second angled ends.

* * * * *

UNITED STATES PATENT AND TRADEMARK OFFICE

CERTIFICATE OF CORRECTION

PATENT NO. : 5,354,018

DATED : October 11, 1994

INVENTOR(S) : Edwin deS. Snead

It is certified that error appears in the above-identified patent and that said Letters Patent is hereby corrected as shown below:

column 8, line 38, delete "92" and insert --72--.

In claim 7 at column 10, line 41, after "first", insert --,--.

Signed and Sealed this

Twenty-seventh Day of December, 1994

Bruce Lehman

*Attest:*

BRUCE LEHMAN

*Attesting Officer*

*Commissioner of Patents and Trademarks*